US009433953B2

(12) United States Patent
Ghesla et al.

(10) Patent No.: US 9,433,953 B2
(45) Date of Patent: Sep. 6, 2016

(54) REVERSIBLE COATING MATERIAL NOZZLE FOR A SPRAY GUN FOR COATING A WORKPIECE WITH COATING MATERIAL

(75) Inventors: Jurgen Ghesla, Hard (AT); Rolf Mazenauer, Widnau (CH)

(73) Assignee: J. Wagner AG, Altstatten (CH)

( * ) Notice: Subject to any disclaimer, the term of this patent is extended or adjusted under 35 U.S.C. 154(b) by 0 days.

(21) Appl. No.: 14/009,355

(22) PCT Filed: Apr. 3, 2012

(86) PCT No.: PCT/CH2012/000078

§ 371 (c)(1),
(2), (4) Date: Oct. 2, 2013

(87) PCT Pub. No.: WO2012/135966

PCT Pub. Date: Oct. 11, 2012

(65) Prior Publication Data

US 2014/0044881 A1 Feb. 13, 2014

(30) Foreign Application Priority Data

Apr. 4, 2011 (EP) ..... 1140524

(51) Int. Cl.

| | |
|---|---|
| ***B05B 5/025*** | (2006.01) |
| ***B05B 5/03*** | (2006.01) |
| ***B05B 7/08*** | (2006.01) |
| ***B05B 15/02*** | (2006.01) |
| *B05B 1/04* | (2006.01) |
| *B05B 9/01* | (2006.01) |
| *B05B 13/04* | (2006.01) |

(52) U.S. Cl.

CPC ..... *B05B 5/025* (2013.01); *B05B 5/03* (2013.01); *B05B 7/0815* (2013.01); *B05B 15/0283* (2013.01); *B05B 1/042* (2013.01); *B05B 9/01* (2013.01); *B05B 13/041* (2013.01); *B05B 13/0431* (2013.01)

(58) Field of Classification Search

CPC ..... B05B 15/0283; B05B 5/025; B05B 5/03; B05B 9/01

USPC ..... 239/601, 690; 427/421.1

See application file for complete search history.

(56) References Cited

U.S. PATENT DOCUMENTS

| | | |
|---|---|---|
| 3,563,463 A | 2/1971 | Walker |
| 4,074,857 A | 2/1978 | Calder |

(Continued)

FOREIGN PATENT DOCUMENTS

DE 298 01 651 U1 5/1999

OTHER PUBLICATIONS

International Search Report for corresponding International Application No. PCTCH2012/000078 mailed Sep. 17, 2012.

*Primary Examiner* — Alexander Weddle

(74) *Attorney, Agent, or Firm* — Renner, Otto, Boisselle & Sklar, LLP

(57) ABSTRACT

The reversible coating material nozzle for a spray gun for coating a workpiece with coating material can be installed in a first and a second installation position in a nozzle mount of the spray gun and comprises a nozzle core having a nozzle core opening and a nozzle nipple that is connected to the nozzle core and has a nozzle nipple opening. In addition, a nozzle channel for the coating material is provided and reaches through the nozzle nipple and the nozzle core and connects the nozzle nipple opening to the nozzle core opening. The nozzle nipple has a cylindrical portion, which in the first installation position forms a form fit with the nozzle mount of the spray gun. In addition, a stop is provided. The ratio between the length (L) from the stop to the cylindrical portion and the nozzle diameter (D) lies in the range between 0.75 and 2.00.

20 Claims, 5 Drawing Sheets

(56) References Cited

U.S. PATENT DOCUMENTS

| | | | | |
|---|---|---|---|---|
| 4,157,163 | A * | 6/1979 | Pinto et al. | 239/119 |
| 5,190,224 | A * | 3/1993 | Hamilton | 239/600 |
| 5,820,025 | A * | 10/1998 | Troudt | 239/119 |
| 6,390,386 | B2 * | 5/2002 | Krohn et al. | 239/119 |
| 2003/0006322 | A1 * | 1/2003 | Hartle et al. | 239/691 |
| 2003/0098369 | A1 * | 5/2003 | Foster et al. | 239/343 |
| 2004/0195354 | A1 | 10/2004 | Leisi | |
| 2005/0082257 | A1 * | 4/2005 | Bierings et al. | 216/83 |
| 2005/0224602 | A1 * | 10/2005 | Foubert et al. | 239/463 |

* cited by examiner

REVERSIBLE COATING MATERIAL NOZZLE FOR A SPRAY GUN FOR COATING A WORKPIECE WITH COATING MATERIAL

TECHNICAL FIELD

The invention relates to a reversible coating material nozzle for a spray gun for coating a workpiece with coating material.

When coating a workpiece with a coating material, such as paint, a spray gun if often used that sprays the pressurised coating material through a coating material nozzle. In particular if there are particles of dirt in the coating material, the coating material nozzle may become blocked. If the spray gun continues to be used, either no more coating material will be sprayed or only an insufficient quantity of coating material will still be sprayed. The coating material nozzle then has to be cleaned. To this end, the trigger of the spray gun is locked, for example using a trigger lock, such that no more coating material can exit from the spray gun. With an electrostatic spray gun, the locking of the trigger additionally ensures that a high voltage is no longer applied across the high-voltage electrode. The coating material nozzle can then be dismantled. The blocked coating material nozzle then has to be cleaned manually, for example with solvent and a fine cleaning needle. The coating material nozzle then has to be reinstalled in the spray gun. Once the trigger lock is released again, the spray gun is again ready for operation. This process requires a lot of time. It may be during the manual cleaning process that the coating material nozzle is damaged and has to be replaced by a new nozzle. In addition, it may be that the blocked coating material nozzle can no longer be cleaned manually and then likewise has to be replaced.

PRIOR ART

A satisfactory solution is not previously known from the prior art.

DISCLOSURE OF THE INVENTION

One object of the invention is to specify a reversible coating material nozzle for a spray gun for coating workpieces with coating material, the reversible coating material nozzle being designed such that it can be used to coat a workpiece and is also self-cleaning where necessary.

A further object of the invention is to be able to dismantle the coating material nozzle from the spray gun head and to be able to install it in the spray gun head without an additional tool, that is to say merely by hand, in spite of its small dimensions.

The coating material nozzle is advantageously easily removable from the spray gun and centres itself automatically during installation.

The object is achieved by a reversible coating material nozzle for a spray gun for coating workpieces with coating material having the features specified in patent claim 1.

The reversible coating material nozzle according to the invention for a spray gun for coating a workpiece with coating material is designed such that it can be installed in a first and a second installation position in a nozzle mount of the spray gun. It comprises a nozzle core with a nozzle core opening and a nozzle nipple connected to the nozzle core, the nozzle nipple having a nozzle nipple opening. In addition, a nozzle channel for the coating material is provided and reaches through the nozzle nipple and the nozzle core and connects the nozzle nipple opening to the nozzle core opening. The nozzle nipple has a cylindrical portion, which in the first installation position forms a form fit with the nozzle mount of the spray gun. In addition, a stop is provided. The ratio between the length from the stop to the cylindrical portion and the nozzle diameter lies in the range between 0.75 and 2.00.

Advantageous developments of the invention will emerge from the features specified in the dependent patent claims.

In an embodiment of the coating material nozzle according to the invention, the ratio between the length and the nozzle diameter lies in the range between 0.80 and 1.35.

In a further embodiment of the coating material nozzle according to the invention, the nozzle nipple has a cone, which in the first installation position forms a form fit with the nozzle mount of the spray gun. The nozzle core likewise has a cone, which in the second installation position forms a form fit with the nozzle mount.

In a development of the coating material nozzle according to the invention, the nozzle nipple is made of plastic. This has the advantage that the nozzle nipple can be produced from an economical material and can be produced by means of injection moulding.

In another development of the coating material nozzle according to the invention, the nozzle core is made of carbide metal or ceramic. The service life of the nozzle is thus extended. In addition, in this development, even abrasive coating material can be sprayed.

In an additional development of the coating material nozzle according to the invention, the nozzle nipple has a further cylindrical portion, which forms a form fit with the nozzle core. Tolerances during the production of this portion do not play a specific role. Even a potential material pressing is not critical or is even beneficial for the tightness.

In an embodiment of the coating material nozzle according to the invention, a seal is provided between the nozzle core and the nozzle nipple. The tightness between the nozzle nipple and the nozzle core can thus be increased, and it is possible to ensure that the coating material exits from the coating material nozzle exclusively through the nozzle core opening.

In a further embodiment of the coating material nozzle according to the invention, a nozzle holder is provided, which holds together the nozzle core and the nozzle nipple. In this embodiment, the nozzle nipple can also be produced from carbide metal or ceramic. The service life of the coating material nozzle can thus be further increased.

In a further embodiment of the coating material nozzle according to the invention, the nozzle holder is made of plastic. Such a coating material nozzle can be produced cost-effectively by means of injection moulding.

It is additionally proposed, with the coating material nozzle according to the invention, to form the connection between the nozzle holder and the nozzle nipple as a snap-fit connection. This likewise facilitates the production. The nozzle holder and the nozzle nipple can be interconnected however by adhesive bonding, welding or by a pressing process.

In the coating material nozzle according to the invention, the plastic may be electrically non-conductive. Such a coating material nozzle can be used in an electrostatic spray gun. As a result of the non-conductive plastic, the electrical charge of the high-voltage-carrying electrode at the spray gun head does not reach the housing of the spray gun. In addition, an inadmissible increase of the capacitance with respect to earth potential is thus avoided. A sudden discharge is prevented. In the case of an electrostatic spray gun, this additionally has the advantage that the electrical capacitance of the coating nozzle is reduced due to the lower fraction of metal. Since less electrical charge can thus be stored, the risk of a sudden discharge is reduced.

In an additional embodiment of the coating material nozzle according to the invention, a shoulder is provided which has a diameter of at least 5 mm and at most 15 mm and forms an axial stop.

In the coating material nozzle according to the invention, the nozzle nipple is advantageously an injection-moulded part, which surrounds the nozzle core in part. This embodiment is also cost effective and can be produced easily.

In addition, in the coating material nozzle according to the invention, the shoulder can be formed in such a way that it forms a form fit with an air cap of the spray gun in the installed state. If the air cap is rotated about its longitudinal axis, the coating material nozzle also rotates. This is advantageous in particular if the nozzle core opening is formed in a slit-shaped manner. The flat jet produced by the coating material nozzle can thus be rotated and adapted to the respective requirements during the coating process.

In a further embodiment of the coating material nozzle according to the invention, the lateral surface of the shoulder has a flat area. During the installation of the coating material nozzle, the flat area of the shoulder is aligned with the flat area of the air cap.

The spray gun according to the invention for coating a workpiece with coating material has a coating material nozzle which is formed as described above.

In the spray gun according to the invention, the nozzle mount may have a bore for receiving the nozzle nipple.

In addition, the spray gun may have a high-voltage electrode.

The coating material nozzle according to the invention can be used in a spray gun for coating a workpiece with coating material.

Lastly, a method for operating the above-described spray gun for coating a workpiece with coating material is proposed, in which the coating material nozzle is installed in the first installation position in the spray gun when the spray gun is to function in coating operation. If the spray gun is to function in cleaning operation, the coating material nozzle is installed in the second installation position in the spray gun.

BRIEF DESCRIPTION OF THE DRAWINGS

The invention will be explained in greater detail hereinafter with a number of exemplary embodiments on the basis of six figures.

EMBODIMENTS OF THE INVENTION

Figure 1:
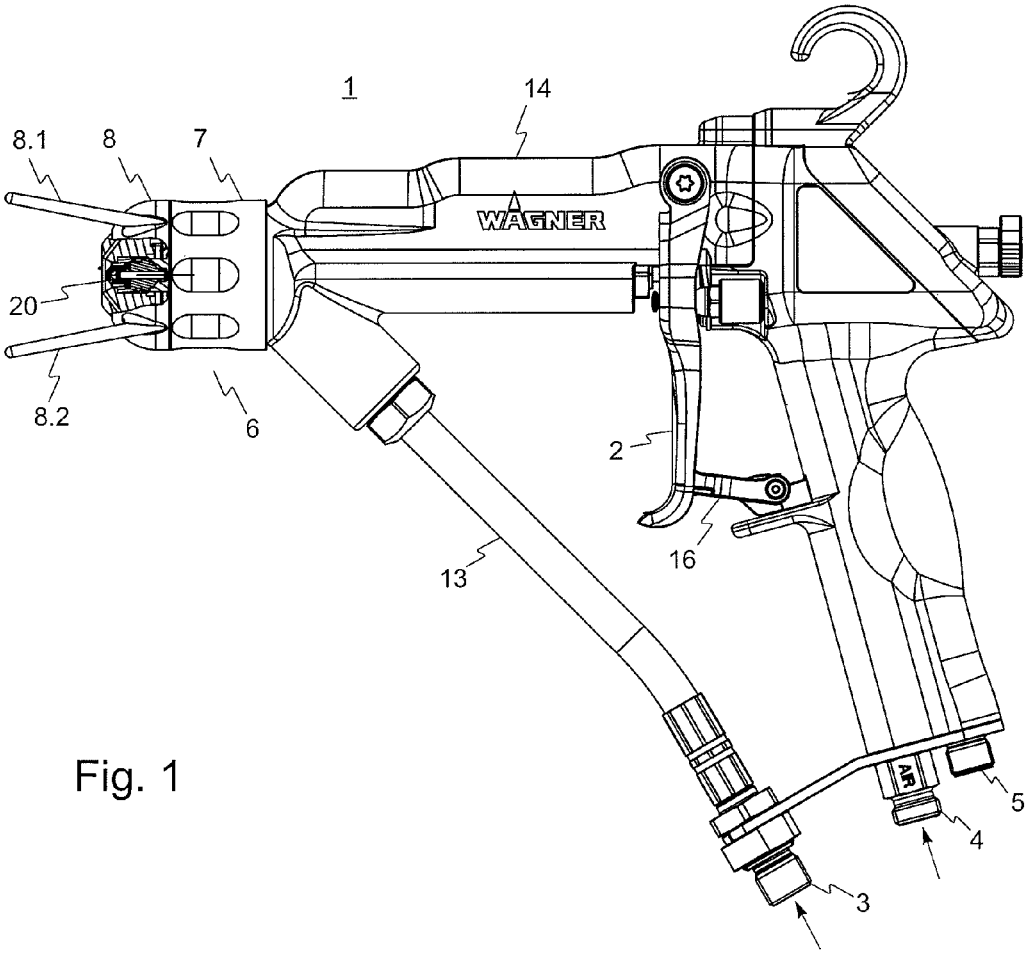
FIG. 1 shows a side view of an embodiment of the spray gun according to the invention with a first embodiment of the reversible coating material nozzle according to the invention.
Figure 2:
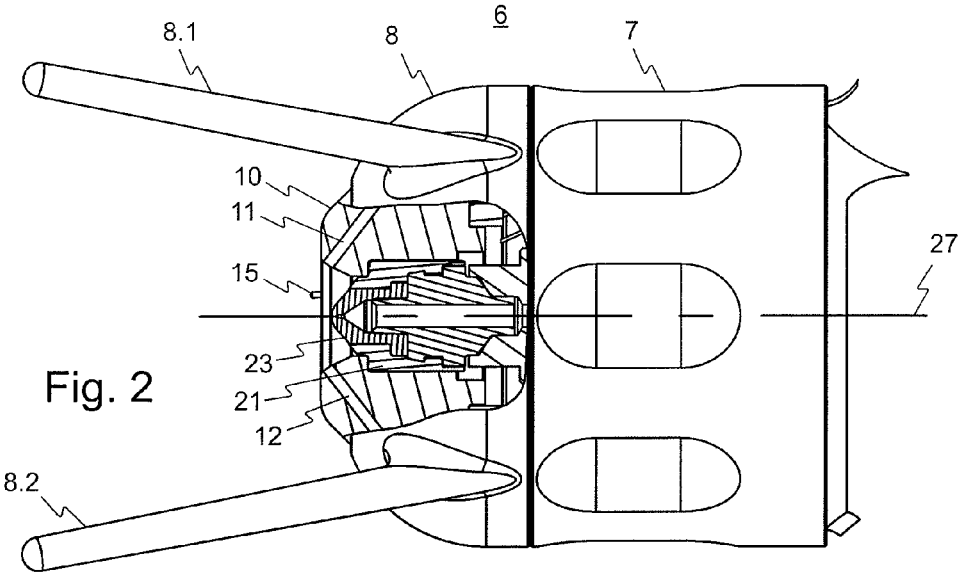
FIG. 2 shows an enlarged partial sectional view of the spray head of the spray gun from FIG. 1 with the coating material nozzle in a first installation position.
Figure 3:
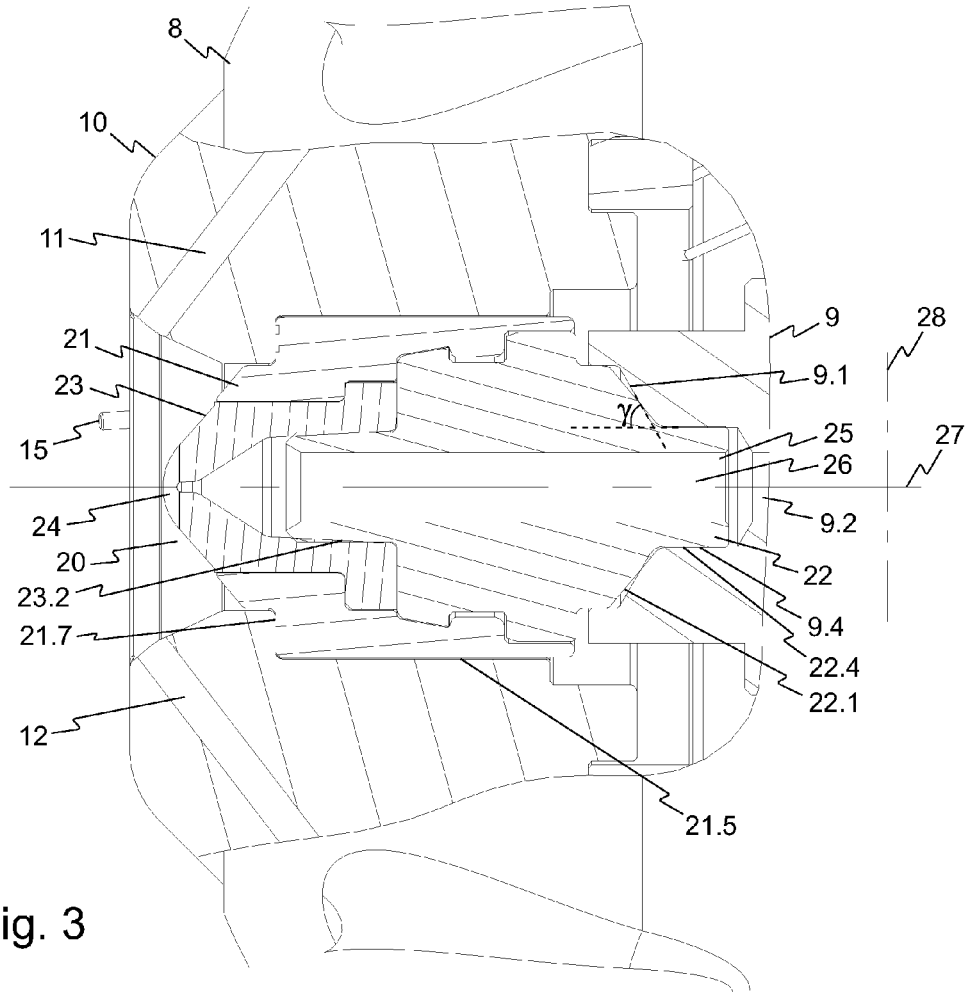
FIG. 3 shows a detail, again in an enlarged view, of the spray head with the coating material nozzle in the first installation position.

FIG. 1 shows a side view of an embodiment of the spray gun 1 according to the invention with a first embodiment of the reversible coating material nozzle 20 according to the invention. The coating material nozzle 20 will also be referred to hereinafter just as a nozzle for the sake of simplicity. The spray gun 1 comprises a gun housing 14, which will also be referred to hereinafter as the housing of the spray gun. A spray gun head 6 is located at the front end of the spray gun 1. Part of the spray gun head is illustrated in section in FIG. 1. The spray gun head 6 is screwed onto the gun housing 14 by means of a cap nut 7. Inside the spray gun head 6, a coating material nozzle 20 is located, which is illustrated in FIGS. 1, 2 and 3 in a first installation position. The coating material nozzle 20 is held in the spray gun head 6 by means of the cap nut 7.

In addition, the spray gun head 6 comprises a nozzle protector 8, which is optional however. As a result of the nozzle protector, the risk of the operator coming directly into contact with the coating material at the nozzle outlet 24 of the coating material nozzle 20 (see FIG. 3) is reduced. Contact with the coating material is to be avoided particularly at that location, because the coating material there may cause injury due to the high pressure and, if it comes directly into contact with the skin, may penetrate the skin. Due to the nozzle protector 8, the risk of the coating material penetrating the skin is thus reduced, and a potential damaging effect is minimised. The nozzle protector 8 will also be referred to hereinafter as a contact protector and comprises a plurality of spacers 8.1 and 8.2. In the embodiment shown in FIG. 1, the contact protector 8 has four spacers, wherein, due to the sectional illustration, merely two can be seen. The contact protector may also be equipped with just two or three spacers. It is additionally possible to provide five or more spacers.

The coating material nozzle 20 is supplied via a material line 13. This is in turn connectable to a material tube (not shown in the figures) via a connection for coating material 3.

The spray gun 1 further has a connection for compressed air 4. The compressed air can be directed to the coating material jet as required by shaping air channels 11 and 12, which are located in the downstream region in an air cap 10 of the spray head 8. With the aid of the compressed air, the shape of the coating material jet can be adapted.

Furthermore, the spray gun 1 comprises an electric connection 5, via which an electrode 15 on the spray gun head 6 can be supplied with high voltage. The high voltage is used to ionise the coating material. A spray gun formed in this way will also be referred to hereinafter as an electrostatic gun.

In order to control the flow of coating material, the spray gun 1 also comprises a trigger guard 2. With actuation thereof, a valve arranged in the spray gun 1 is opened via a valve stem such that the coating material reaches the coating material nozzle 20 and is sprayed therethrough. With the aid of a trigger lock 16, the trigger guard 2 can be locked. In the locked state, the trigger guard 2 can no longer be actuated, such that no more coating material can be sprayed.

FIG. 2 shows an enlarged partial sectional view of the spray head 6 of the spray gun 1 from FIG. 1 with the coating material nozzle 20 in a first installation position. FIG. 3 shows a detail of the spray head 6 with the coating material nozzle 20 in the first installation position in a view that is enlarged to an even greater extent. If the coating material nozzle 20 is in the first installation position, as is shown in FIGS. 1, 2 and 3, the spray gun 1 functions in coating operation or coating mode. Workpieces can then be coated with coating material using the spray gun 1. In the first installation position, the cylindrical portion 22.4 of the nozzle nipple 22 plugs into a nozzle mount 9, which for this purpose has an accordingly large bore 9.4. The cylindrical portion 22.4 forms a form fit together with the bore 9.4. When the pressurised coating material flows through the material channel 9.2, it pushes the cylindrical portion 22.4 against the wall of the bore 9.4 and thus provides an improved seal at the transition between the material channel 9.2 and the nozzle nipple 22. Even if the coating material nozzle 20 is to be frequently disassembled and reinserted, the seal effect is maintained in an unchanged manner. If the terms cylinder-shaped or cylindrical are used hereinafter, a slightly conical shape is also to be included thereby. In this context, slightly conical means that the angle between the longitudinal axis and the cone is between 0 and 5°. This means that the deviation with respect to a mathematically exactly cylindrical shape is therefore not to exceed 5°. The nozzle nipple 22 additionally has a cone 22.1, which forms a further form fit with a likewise inclined area 9.1 of the nozzle mount 9. The inclined area 9.1 helps to introduce the nozzle nipple 22.4 into the bore 9.4 of the nozzle mount 9. A nozzle core 23 is located at the downstream end of the coating material nozzle 20. The coating material, when the trigger lever 2 is actuated, is transported through the bore 9.2 (which also serves as a coating material channel) and through the coating material channel 26 to the nozzle core opening 24, where it is sprayed.

Figure 4:
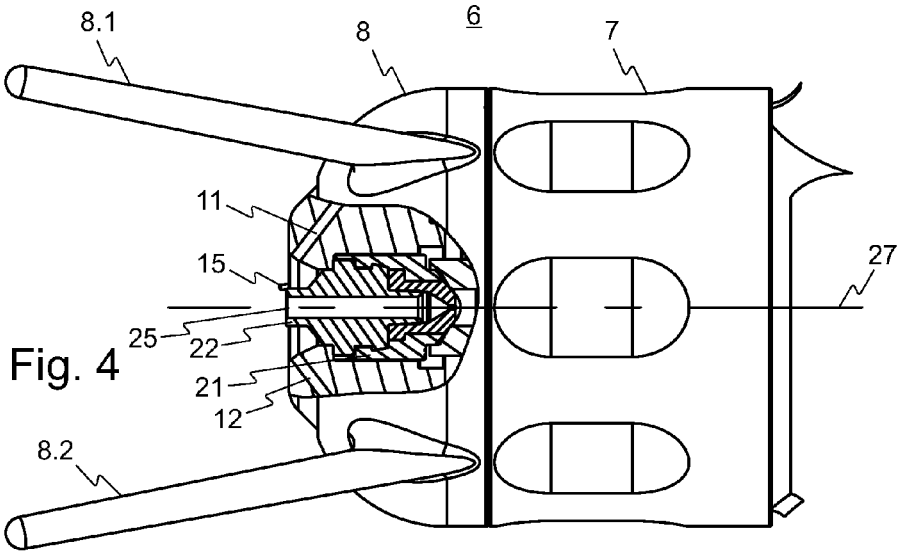
FIG. 4 shows an enlarged partial sectional view of the spray head of the spray gun from FIG. 1 with the coating material nozzle in a second installation position.

FIG. 4 shows an enlarged partial sectional view of the spray head 6 of the spray gun 1 from FIG. 1 with the coating material nozzle 20 in a second installation position. In the second installation position, the coating material nozzle 20 is installed in the spray head 6, rotated through 180°. The cone 23.1 of the nozzle core 23 then forms a form fit together with the inclined area 9.1 of the nozzle mount 9. The nozzle nipple 22 is located at the downstream end of the spray head 6. The opening 25 in the nozzle nipple then forms the material outlet of the spray gun 1. If the trigger lever 2 of the spray gun 1 is then actuated, the coating material first flows through the nozzle core opening 24 of the coating material nozzle 20 and entrains deposits located in the region of the nozzle core opening 24. The deposits are pushed out from the spray gun 1 through the nozzle nipple opening 25. The coating material nozzle 20 is then cleaned and can be brought again into the first installation position. To this end, the cap nut 7 is unscrewed from the spray gun housing 14, the coating material nozzle 20 is removed, rotated through 180°, and is again plugged into the nozzle mount 9. The cap nut 7 is then screwed onto the spray gun housing 14, and the spray gun 1 is ready for use again in order to coat the next workpieces.

Figure 5A:
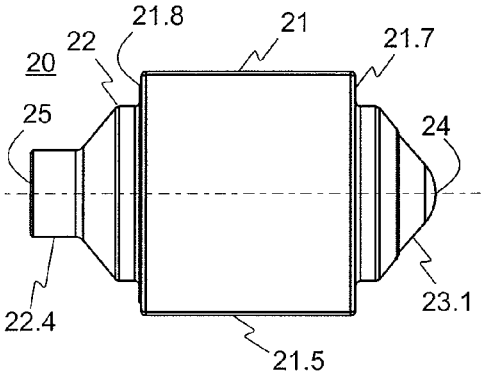
FIG. 5*a* shows a side view of the first embodiment of the coating material nozzle.
Figure 5B:
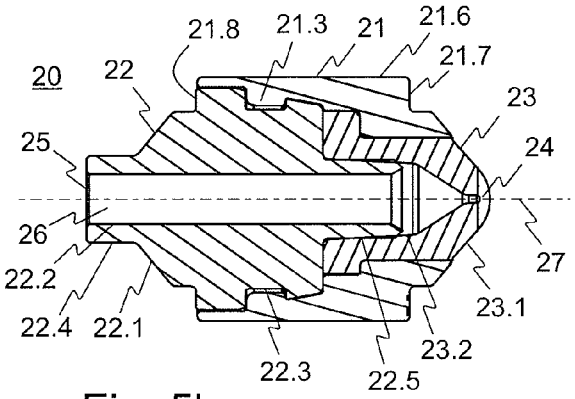
FIG. 5*b* shows a cross-sectional view from the side of the first embodiment of the coating material nozzle.
Figure 5C:
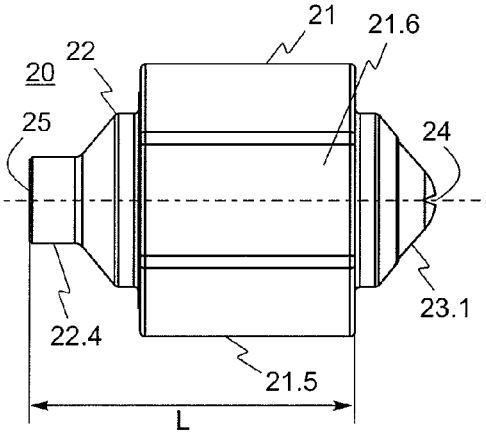
FIG. 5*c* shows a plan view of the first embodiment of the coating material nozzle.
Figure 5D:
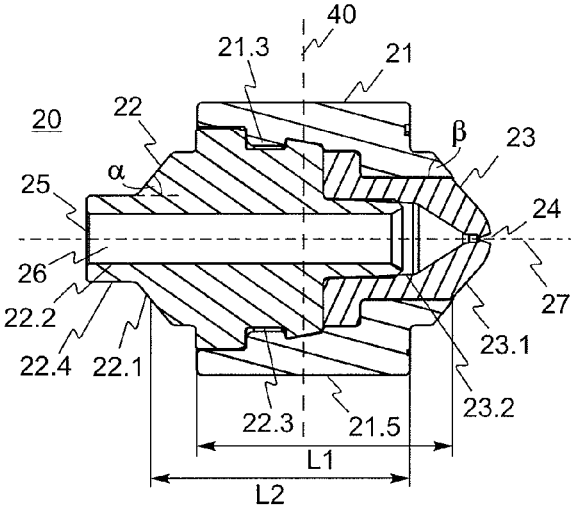
FIG. 5*d* shows a cross-sectional view from above of the first embodiment of the coating material nozzle.
Figure 5E:
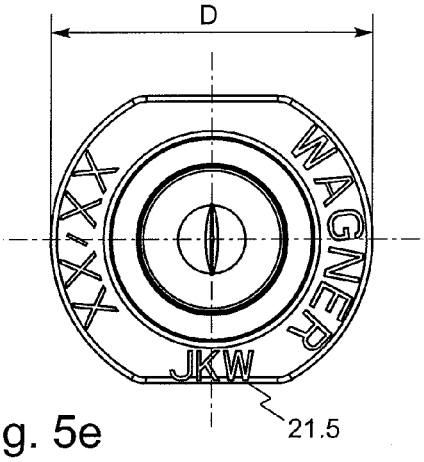
FIG. 5*e* shows the first embodiment of the coating material nozzle in a view from the front.
Figure 5F:
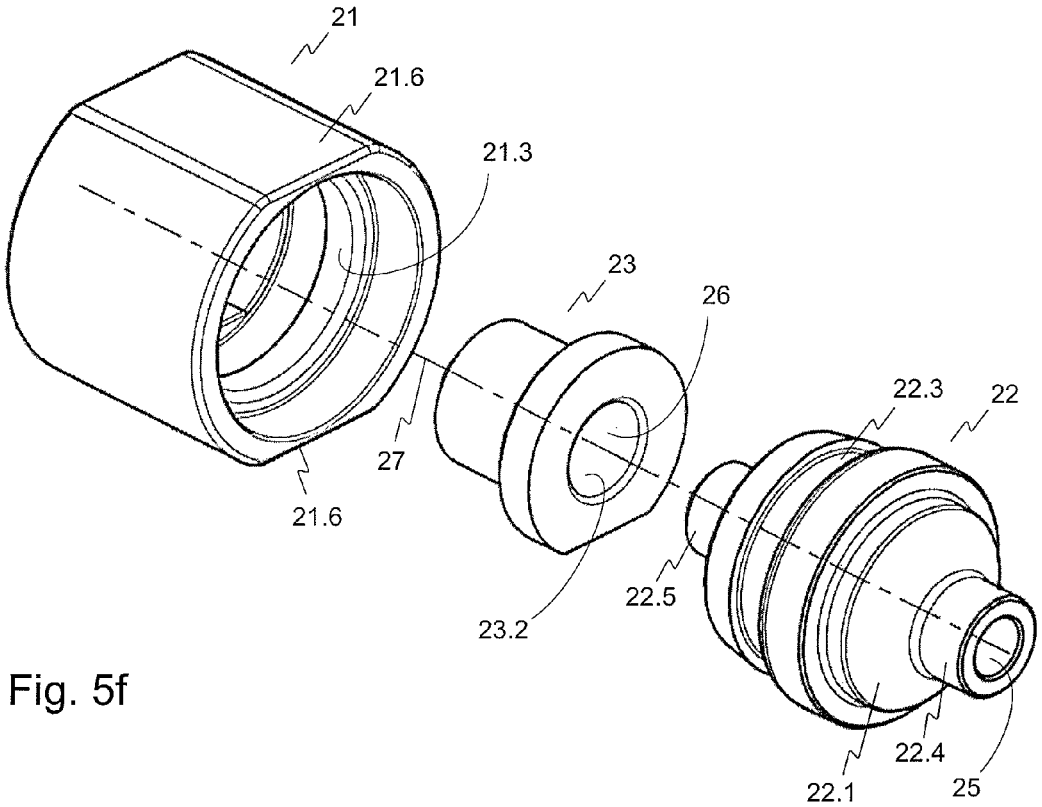
FIG. 5*f* shows an exploded view of the first embodiment of the coating material nozzle.

FIG. 5*a* shows the first embodiment of the coating material nozzle 20 in side view, and FIG. 5*c* shows this in plan view. FIG. 5*b* shows the first embodiment of the coating material nozzle 20 in cross section from the side, and FIG. 5*d* shows this in cross section from above. FIG. 5*e* shows the first embodiment of the coating material nozzle 20 in a view from the front.

The nozzle holder 21 is designed such that it holds together the nozzle nipple 22 and the nozzle core 23. The connection between the nozzle holder 21 and the nozzle nipple 22 can be designed as a snap-fit connection 21.3, 22.3. To this end, the nozzle holder 21 has a resilient element or a catch 21.3, which engages in a groove 22.3 of the nozzle nipple 22.

The nozzle holder 21 can be produced from plastic. Such a coating material nozzle 20 can be produced cost-effectively by means of injection moulding.

The plastic, from which the nozzle holder 21 and/or the nozzle nipple 22 is/are produced, is preferably an electrically non-conductive plastic. Due to the non-conductive plastic, the electrical charge of the high-voltage-carrying electrode 15 on the spray gun head 6 does not reach the housing 14 of the spray gun 1. In addition, an inadmissible increase of the capacitance with respect to earth potential is thus avoided. A sudden discharge is prevented. Instead of plastic, another electrically non-conductive material may also be used. Such a coating material nozzle can be used in an electrostatic spray gun.

If the coating material nozzle is used for non-electrostatic applications, the plastic may also be electrically conductive, or metal can also be used instead of the plastic. Such a coating material nozzle can be used in a non-electrostatic spray gun. This coating material nozzle can also be used in an electrostatic spray gun if the spray gun is operated without electrostatics.

The nozzle holder 21 also comprises a shoulder 21.5, which serves as an axial stop. It extends between the heel 21.8 and the heel 21.7. In the region of the shoulder 21.5, the coating material nozzle 20 preferably has an outer diameter D of at least 5 mm and at most 15 mm. In a preferred embodiment, the outer diameter D is 11 mm. The shoulder 21.5 is positioned with respect to the cone 23.1 of the nozzle core 23 and the cone 22.1 of the nozzle nipple 22 in the axial direction such that the dimensions L1 and L2 are approximately of identical size. The dimension L1 is defined as the distance between the heel 21.8 and the cone 23.1. The dimension L2 is defined as the distance between the heel 21.7 and the cone 22.1. The ability to install the coating material nozzle 20 both in the first installation position and in the second installation position is thus improved.

In the first installation position, the heel 21.7 forms an axial stop on the shoulder 21.5. If the cap nut 7 is screwed onto the housing 14 of the spray gun, the cap nut 7 via the axial stop 21.7 pushes the cone 22.1 of the coating material nozzle 20 onto the nozzle mount 9.

In the second installation position, the other heel 21.8 of the shoulder 21.5 forms an axial stop. If the cap nut 7 is screwed onto the housing 14 of the spray gun, the cap nut 7 via the axial stop 21.8 pushes the cone 23.1 of the nozzle core 23 onto the nozzle mount 9.

The coating material channel 26 reaches through the nozzle nipple 22 and the nozzle core 23 and connects the nozzle nipple opening 25 to the nozzle core opening 24.

In order to increase the tightness between the nozzle nipple 22 and the nozzle core 23, a seal (not shown in the figures) can be provided between the nozzle core 22 and the nozzle nipple 23. The seal can be formed as an axial seal, for example as an O-ring.

As shown in FIGS. 5*b* and 5*d*, the seal can be improved if the nozzle nipple 22 has a cylindrical portion 22.5, which protrudes into the nozzle core 23. As soon as the coating material flows through the nozzle channel 26, it pushes the portion 22.5 against the channel wall 23.2 of the nozzle core 23 and thus provides an improved seal at the channel transition between the nozzle nipple 22 and the nozzle core 23.

The coating material nozzle 20 has a length L in the range from 10.0 mm to 14.6 mm and preferably of 12.3 mm. The nozzle diameter is preferably 11 mm. The dimensions of the coating material nozzle 20 are relatively small, however it can still be grasped by hand.

These dimensions give a ratio between the length L and the nozzle diameter D from 0.91 to 1.33. A ratio of L/D in the region from $0.75 \leq L/D \leq 2$ can still be tolerated. The length L and the nozzle diameter D are preferably matched to one another such that the ratio L/D is 1.12. With this ratio of L/D, the coating material nozzle 20 can be installed optimally in the spray gun head 6. If the ratio L/D lies outside the above-specified region, the coating material nozzle 20 may tilt both during disassembly and during installation in the spray gun head 6, such that the installation or disassembly without an additional tool is then only still possible with difficulty, if at all, and requires a relatively large amount of time and a relatively large amount of patience.

Figure 6A:
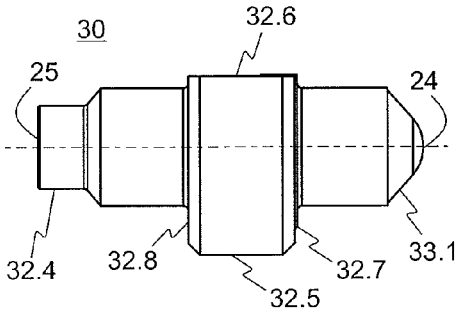
FIG. 6*a* shows a side view of a second embodiment of the coating material nozzle.
Figure 6B:
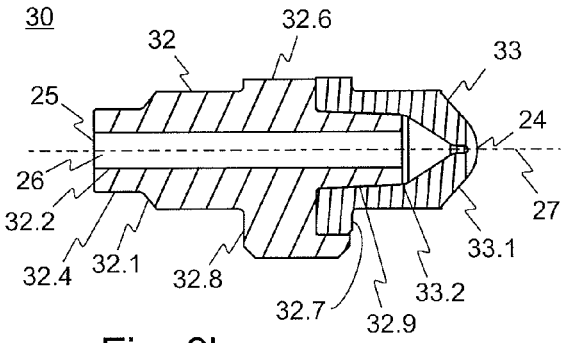
FIG. 6*b* shows a cross-sectional view from the side of the second embodiment of the coating material nozzle.
Figure 6C:
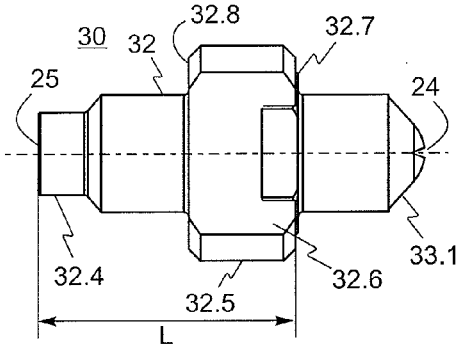
FIG. 6*c* shows a plan view of the second embodiment of the coating material nozzle.
Figure 6D:
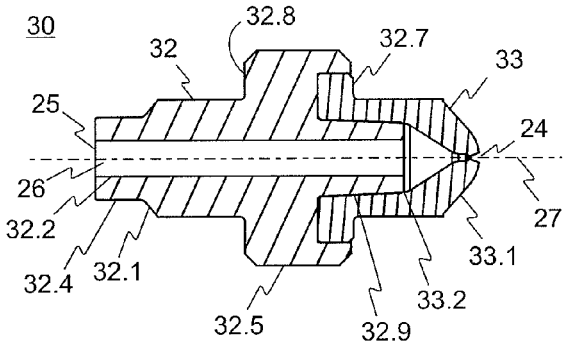
FIG. 6*d* shows a cross-sectional view from above of the second embodiment of the coating material nozzle.
Figure 6E:
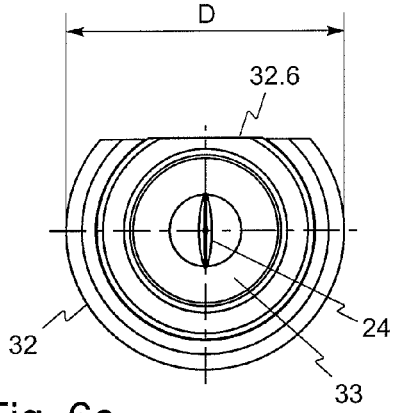
FIG. 6*e* shows the second embodiment of the coating material nozzle in a view from the front.

FIG. 6*a* shows a second embodiment of the coating material nozzle 30 in side view, and FIG. 6*c* shows this in plan view. FIG. 6*b* shows the second embodiment of the coating material nozzle 30 in cross section from the side, and FIG. 6*d* shows this in cross section from above. FIG. 6*c* shows the second embodiment of the coating material nozzle 30 in a view from the front. The second embodiment of the coating material nozzle 30 differs from the first embodiment substantially in that the nozzle nipple 32 is not only connected to the nozzle core 33 in a form-fitting manner, but also in a force-locked manner. The nozzle nipple 32 is shaped and designed such that it additionally also takes on the function of the nozzle holder 21.

The nozzle nipple 32 comprises a shoulder 32.5, which serves as an axial stop. It is located approximately in the middle of the coating material nozzle 30 and reaches from the heel 32.8 to the heel 32.7. In the region of the shoulder 32.5, the coating material nozzle 30 preferably has an outer diameter of at least 5 mm and at most 15 mm.

In the first installation position, the heel 32.7 on the shoulder 32.5 forms an axial stop. If the cap nut 7 is screwed onto the housing 14 of the spray gun, the cap nut 7 via the axial stop 32.7 pushes the cone 32.1 of the coating material nozzle 30 onto the nozzle mount 9.

In the second installation position, the other heel 32.8 of the shoulder 32.5 forms an axial stop. If the cap nut 7 is screwed onto the housing 14 of the spray gun, the cap nut 7 via the axial stop 32.8 pushes the cone 33.1 of the nozzle core 33 onto the nozzle mount 9 (see also FIG. 4).

The coating material nozzle 30 has a length L in the range from 7.3 mm to 11.3 mm and preferably of 9.3 mm. The nozzle diameter D is preferably 9 mm. The dimensions of the coating material nozzle 30 are also relatively small, however they can still be grasped by hand.

These dimensions give a ratio between the length L and the nozzle diameter D from 0.81 to 1.26. A ratio of L/D in the range from $0.75 \leq L/D \leq 2$ can still be tolerated. The length L and the nozzle diameter D are preferably matched to one another such that the ratio L/D is 1.03. With this ratio of L/D, the coating material nozzle 20 can be installed optimally in the spray gun head 6. If the ratio L/D lies outside the above-specified range, the coating material nozzle 30, as already mentioned, may tilt both during disassembly and during installation in the spray gun head 6, such that the installation or disassembly without additional tools is then only possible with difficulty, if at all, and requires a relatively large amount of time and a relatively large amount of patience.

The material from which the nozzle nipple 32 is produced is preferably electrically non-conductive. The electrical charge of the high-voltage-carrying electrode 15 on the spray gun head 6 therefore does not reach the housing 14 of the spray gun 1. In addition, an inadmissible increase in the capacitance with respect to earth potential is thus avoided. A sudden discharge is prevented. The nozzle nipple 32 therefore provides the electrical insulation between the high-voltage-carrying components and the generally earthed components of the spray gun 1. Such a coating material nozzle can be used in an electrostatic spray gun.

The nozzle nipple 32 may be an injection-moulded part, which surrounds the nozzle core 33 in part. This embodiment is also cost-effective and can be produced easily.

The tightness between the nozzle nipple 32 and the nozzle core 33, as shown in FIGS. 6*b* and 6*d*, can be improved if the nozzle nipple 32 has a cylindrical portion 32.9, which protrudes into the nozzle core 33. As soon as the coating material flows through the nozzle channel 26, it pushes the portion 32.9 against the channel wall 33.2 of the nozzle core 33 and thus provides an improved seal at the channel transition between the nozzle nipple 32 and the nozzle core 33.

In order to increase the tightness between the nozzle nipple 32 and the nozzle core 33, a seal (not shown in FIGS. 6*a* to 6*e*) can be provided between the nozzle nipple 32 and the nozzle core 33. The seal can be formed as an axial seal, for example as an O-ring.

The cylindrical portions 22.4 and 22.5 and also 32.4 and 32.9 of the nozzle nipples 22 and 32 respectively additionally have the advantage that they are not susceptible to tolerances and material pressing.

The nozzle cores 23 and 33 can be made of hard metal or ceramic. The service life of the coating material nozzles 20 and 30 is thus extended. In addition, even abrasive coating material can be sprayed using such coating material nozzles without resulting in excessive wear.

The nozzle nipples 22 and 32 can also be produced from carbide metal or ceramic. The service times of the coating material nozzles 20 and 30 can thus be increased further still.

The angles $\alpha$, $\beta$ and $\gamma$ (see FIGS. 3 and 5*d*) are preferably matched to one another. The angle $\gamma$ denotes the angle between the longitudinal axis 27 and the inclination of the cone 9.1 (inner cone) of the nozzle mount 9. The angle $\alpha$ denotes the angle between the longitudinal axis 27 and the inclination of the cone 22.1 (outer cone). The angle $\beta$ lastly denotes the angle between the longitudinal axis 27 and the inclination of the cone 23.1 (outer cone). If all three angles $\alpha$, $\beta$ and $\gamma$ are of approximately equal size, the cones 22.1 and 9.1 and also 23.1 and 9.1 can be used as a stop and/or as a seal. The same is true in turn also for the coating material nozzle 30.

The shoulder 21.5 or 32.5 can be designed both in the case of the coating material nozzle 20 and in the case of the coating material nozzle 30 in such a way that it forms a form fit with the air cap 10 of the spray gun 1. If the air cap 10 is rotated about its longitudinal axis, the coating material nozzle 20 or 30 also rotates. This is advantageous in particular if the nozzle core opening 24 is formed in a slit-shaped manner. The flat jet produced by the coating material nozzle 20 or 30 can thus be rotated and adapted to the respective requirements during the coating process. To this end, as shown in FIGS. 5*a*-5*e* and 6*a*-6*e*, the lateral surface of the shoulders 21.5 and 32.5 may have a flat area 21.6 of 32.6 respectively. When assembling the coating material nozzle 20 or 30, the flat area 21.6 or 32.6 of the shoulder is aligned with the flat area of the air cap 10.

If the coating material nozzle 20 or 30 is installed in the first installation position in the spray gun, the spray gun 1 functions in coating operation, such that workpieces can be coated. If the coating material nozzle 20 or 30 of the spray gun 1 by contrast is to be cleaned, the coating material nozzle is installed in the second installation position in the spray gun 1.

In a further embodiment of the coating material nozzle, the two angles α and β of the cones 22.1 and 23.1 of the coating material nozzle 20 or the two angles α and β of the cones 32.1 and 33.1 of the coating material nozzle 30 may be of approximately identical size.

The coating material nozzle according to the invention can also be used in a spray gun without compressed air assistance. In the case of such a spray gun, the compressed air connection 4 is absent.

The coating material nozzle according to the invention can also be used in an automatic spray gun. An automatic spray gun is understood to mean a spray gun that is not held by hand, but for example is secured or fixedly installed on a robot or a linear guide.

The above description of the exemplary embodiments according to the present invention is provided merely for illustrative purposes and not for the purpose of limiting the invention. Different amendments and modifications are possible within the scope of the invention without departing from the scope of the invention and equivalents thereof. For example, the different coating material nozzles shown in FIGS. 5 and 6 can also be installed in other spray guns. In addition, the individual components can also be combined with one another in a manner other than that shown in figures.

LIST OF REFERENCE SIGNS

1 spray gun
2 trigger guard
3 connection for coating material
4 connection for compressed air
5 electric connection
6 gun head
7 cap nut
8 nozzle protector
8.1 spacer
8.2 spacer
9 nozzle mount
9.1 inclined area
9.2 bore/material channel
9.4 bore
10 air cap
11 shaping air channel
12 shaping air channel
13 coating material line
14 housing of the spray gun
15 electrode
16 trigger lock
20 nozzle
21 nozzle holder
21.3 spring or catch
21.5 shoulder
21.6 flat area
21.7 axial stop
21.8 axial stop
22 nozzle nipple
22.1 cone
22.2 bore
22.3 groove
22.4 cylindrical portion
22.5 cylindrical portion
23 nozzle core
23.1 cone
23.2 bore
24 nozzle core opening
25 nozzle nipple opening
26 nozzle channel
27 longitudinal axis or x-axis
28 y-axis
30 nozzle
32 nozzle nipple
32.1 cone
32.2 bore
32.4 cylindrical portion
32.5 shoulder
32.6 flat area
32.7 axial stop
32.8 axial stop
32.9 cylindrical portion
33 nozzle core
33.1 cone
33.2 bore
40 centre line
L length
D diameter
α angle
β angle
γ angle

The invention claimed is:

1. A reversible coating material nozzle for a spray gun for coating a workpiece with coating material, which can be installed in an operating position and in a cleaning position in a nozzle mount of the spray gun, wherein a nozzle core having a nozzle core opening is provided, wherein a nozzle nipple having a nozzle nipple opening is provided, wherein the nozzle nipple forms a form fit with the nozzle core, wherein a nozzle channel for the coating material is provided, the nozzle channel reaching through the nozzle nipple and the nozzle core and connecting the nozzle nipple opening to the nozzle core opening, wherein the nozzle nipple opening is arranged in the operating position on the upstream side of the nozzle core, wherein the nozzle nipple has a cylindrical portion, which in the operating position forms a form fit with the nozzle mount of the spray gun, wherein an axial stop is provided, wherein the ratio between the axial length (L) from the axial stop to the axial edge of the cylindrical portion and the outer nozzle diameter (D) lies in the range between 0.75 and 2.00.

2. The coating material nozzle according to patent claim 1, wherein the ratio between the axial length (L) to the outer nozzle diameter (D) lies in the range between 0.80 and 1.35.

3. The coating material nozzle according to patent claim 1, wherein the nozzle nipple has a cone, which in the operating position forms a form fit with the nozzle mount of the spray gun, and wherein the nozzle core has a cone, which in the cleaning position forms a form fit with the nozzle mount.

4. The coating material nozzle according to claim 1, wherein the nozzle nipple is made of plastic.

5. The coating material nozzle according to claim 4, wherein the plastic is electrically non-conductive.

6. The coating material nozzle according to patent claim 1, wherein the nozzle core is made of carbide metal or ceramic.

7. The coating material nozzle according to claim 1, wherein the nozzle nipple has a further cylindrical portion, which reaches into the nozzle core.

8. The coating material nozzle according to claim 1, wherein a seal is provided between the nozzle core and the nozzle nipple.

9. The coating material nozzle according to claim 1, wherein a nozzle holder is provided, which holds together the nozzle core and the nozzle nipple.

10. The coating material nozzle according to patent claim 9, wherein the nozzle holder is made of plastic.

11. The coating material nozzle according to patent claim 9, wherein the connection between the nozzle holder and the nozzle nipple is formed as a snap-fit connection.

12. The coating material nozzle according to claim 1, wherein the nozzle nipple is an injection-moulded part, which surrounds the nozzle core in part.

13. The coating material nozzle according to claim 1, wherein a shoulder is provided which has a diameter of at least 5 mm and at most 15 mm and forms an axial stop.

14. The coating material nozzle according to patent claim 13, wherein the shoulder is formed in such a way that it forms a form fit with an air cap of the spray gun in the installed state.

15. The coating material nozzle according to claim 13, wherein the lateral surface of the shoulder has a flat area.

16. A spray gun for coating a workpiece with coating material, wherein a coating material nozzle according to claim 1 is provided.

17. The spray gun according to patent claim 16, wherein the nozzle mount has a bore for receiving the nozzle nipple.

18. The spray gun according to patent claim 16, wherein a high-voltage electrode is provided.

19. A method of coating a workpiece with coating 'material, comprising:

combining the nozzle of claim 1 with a spray gun, and spraying a coating on the workpiece by way of the nozzle.

20. A method for operating a spray gun for coating a workpiece with coating material according to claim 1, wherein the coating material nozzle is installed in the operating position in the spray gun to function in coating operation, and wherein the coating material nozzle is installed in the cleaning position in the spray gun to function in cleaning operation.

* * * * *